United States Patent [19]

Killen

[11] 4,425,013

[45] Jan. 10, 1984

[54] APPARATUS FOR LOCKING CABINET DRAWERS

[75] Inventor: Robert H. Killen, Pasadena, Calif.

[73] Assignee: Pacific Furniture Manufacturing Co., Compton, Calif.

[21] Appl. No.: 267,133

[22] Filed: May 26, 1981

[51] Int. Cl.[3] ..... E05C 15/04; E05B 65/46

[52] U.S. Cl. ..... 312/216; 312/217; 312/221; 312/222

[58] Field of Search ..... 312/215, 216, 217, 218, 312/219, 220, 221, 222, 107.5

[56] References Cited

U.S. PATENT DOCUMENTS

| | | | |
|---|---|---|---|
| 950,813 | 3/1910 | Bodenstein | 312/221 |
| 3,259,444 | 7/1966 | Friend | 312/221 |
| 3,371,974 | 3/1968 | Vermeersch | 312/221 |
| 3,404,929 | 10/1968 | Wright et al. | 312/216 |
| 3,622,216 | 11/1971 | Haunost | 312/222 |
| 3,883,200 | 5/1975 | Latham | 312/216 |
| 3,888,558 | 6/1975 | Himsl | 312/216 |
| 4,246,769 | 1/1981 | McLaughlin | 312/219 |
| 4,272,138 | 6/1981 | Stark | 312/216 |
| 4,303,287 | 12/1981 | Taplin | 312/217 |

FOREIGN PATENT DOCUMENTS

| | | | |
|---|---|---|---|
| 18937 | of 1902 | United Kingdom | 312/221 |

*Primary Examiner*—Victor N. Sakran

*Attorney, Agent, or Firm*—Nilsson, Robbins, Dalgarn, Berliner, Carson & Wurst

[57] ABSTRACT

A system for locking either all or all but one of the drawers of a file cabinet. A bar rides in a groove at the interior of the shell of the cabinet. A plurality of drawer locks is engaged to the bar, each drawer lock including inclined and vertical surfaces at its rear edge. A rail having a key end is positioned at the side of each drawer so that the blunt end of the key faces the inclined surfaces of an associated drawer lock when all drawers are closed. The engagement of the blunt end with the opposed inclined surface of a lock raises the bar so that the blunt ends of the rail members associated with the remaining drawers abut and are locked by the vertical surfaces of the associated drawer locks. A block at the top of the bar abuts the cylinder of a cabinet lock when extended to prevent the vertical movement of the bar, locking all drawers.

5 Claims, 7 Drawing Figures

APPARATUS FOR LOCKING CABINET DRAWERS

BACKGROUND OF THE INVENTION

1. Field of the Invention

The present invention pertains to means for preventing the tipping of a cabinet including a plurality of drawers. In particular, it pertains to means for preventing the opening of more than one drawer of such a cabinet at a time.

2. Description of the Prior Art

The vast amount of records stored by individuals and businesses requires the everyday use of filing cabinets having a plurality of drawers. Such cabinets may include a considerable number of drawers, each of which may be packed with files. The depth of the drawer of a file cabinet is generally extensive. Thus, when full, the drawer and its contents can be of condiserable weight.

The substantial depth and weight of a file drawer can present a tipping hazard when a number of such drawers are opened at the same time. The opening of a drawer not only moves its considerable weight to a position where a resultant moment arm acts upon the shell of the cabinet, but it also removes mass from the shell which would otherwise counteract the tipping moment.

Two main approaches have been utilized in the past to prevent tipping. Counterweights located at the bottom of the cabinet shell have been employed to counteract the force exerted by open drawers. The relatively large amounts of force which open drawers exert necessitate the use of relatively bulky weights for such purpose, substantially increasing the weight of the cabinet. The use of such weights is especially undesirable during shipment of file cabinets. Pulley systems have been utilized to prevent the opening of more than one drawer at a time. Such pulley systems are relatively complex and subject to breakdown. In addition, such systems require considerable clearance space to operate, rendering them incompatible with wood cabinets. Other complex mechanisms for locking drawers in a cabinet include butterfly ears mounted on a shaft which interact with a drawer-mounted cam. The opening of one drawer lifts and rotates the shaft to lock the remaining drawers.

SUMMARY OF THE INVENTION

The present invention overcomes the aforesaid problems by providing simple apparatus for preventing the opening of more than one drawer of a cabinet including a plurality of drawers. The invention includes a member which is vertically movable with respect to the cabinet. A plurality of drawer locks is engaged to the member, each of the drawer locks being associated with one of the plurality of drawers. Each of the drawer locks has an open position and a blocking position, the open position of each being vertically displaced from its blocking position. Each of the drawer keys and drawer locks is so arranged that, upon the opening of one drawer of the cabinet, the member is caused to move vertically so that each of the locks is moved from its open position to its blocking position to prevent the opening of any additional drawers.

The foregoing and additional aspects and features of the present invention will become apparent from the detailed description which follows wherein like numerals represent like parts throughtout.

DETAILED DESCRIPTION

Figure 1:
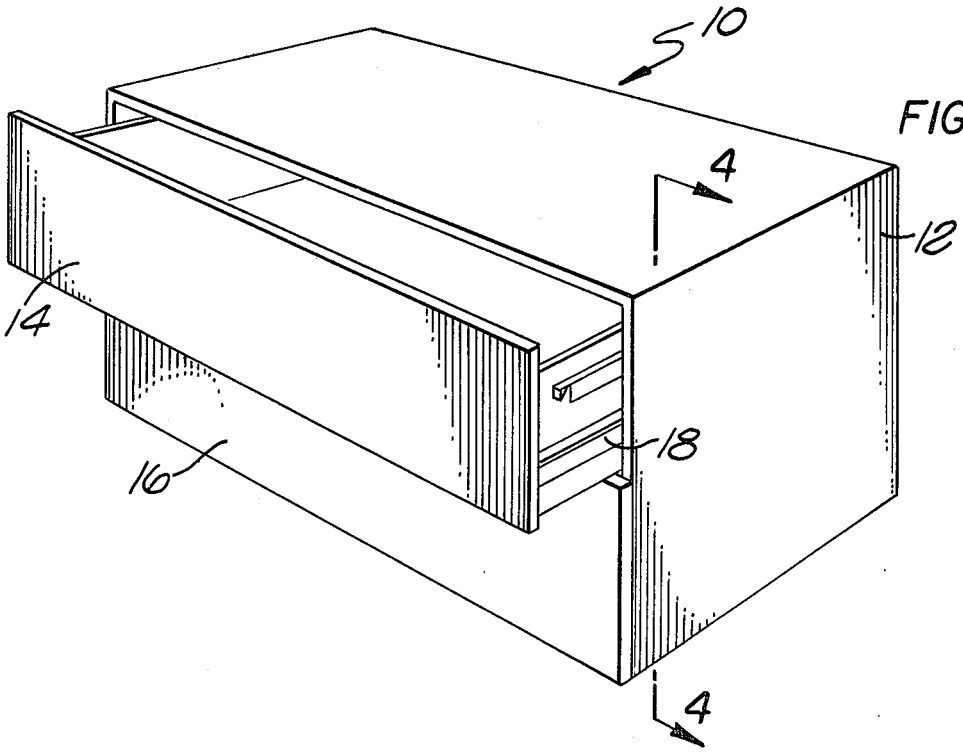
FIG. 1 is a perspective view of a file cabinet which may be adapted to the practice of the present invention.

Turning now to the drawings, FIG. 1 shows a file cabinet 10 which may be adapted to the practice of the present invention. The cabinet 10 includes a wooden shell 12 that provides a frame or housing for file drawers 14 and 16. The file drawers are slidable with respect to the shell. A glide member 18 may be provided to assure the smooth travel of the drawers with respect to the shell 12. Such a glide member 18 may include the mechanism known by the trademark "Accuride" manufactured by Standard Precision Incorporated of Santa Fe Springs, Calif. Although the file cabinet 10 of FIG. 1 is limited to two drawers, it will be appreciated that the present invention may be adapted to cabinets of substantially greater size.

Figure 2:
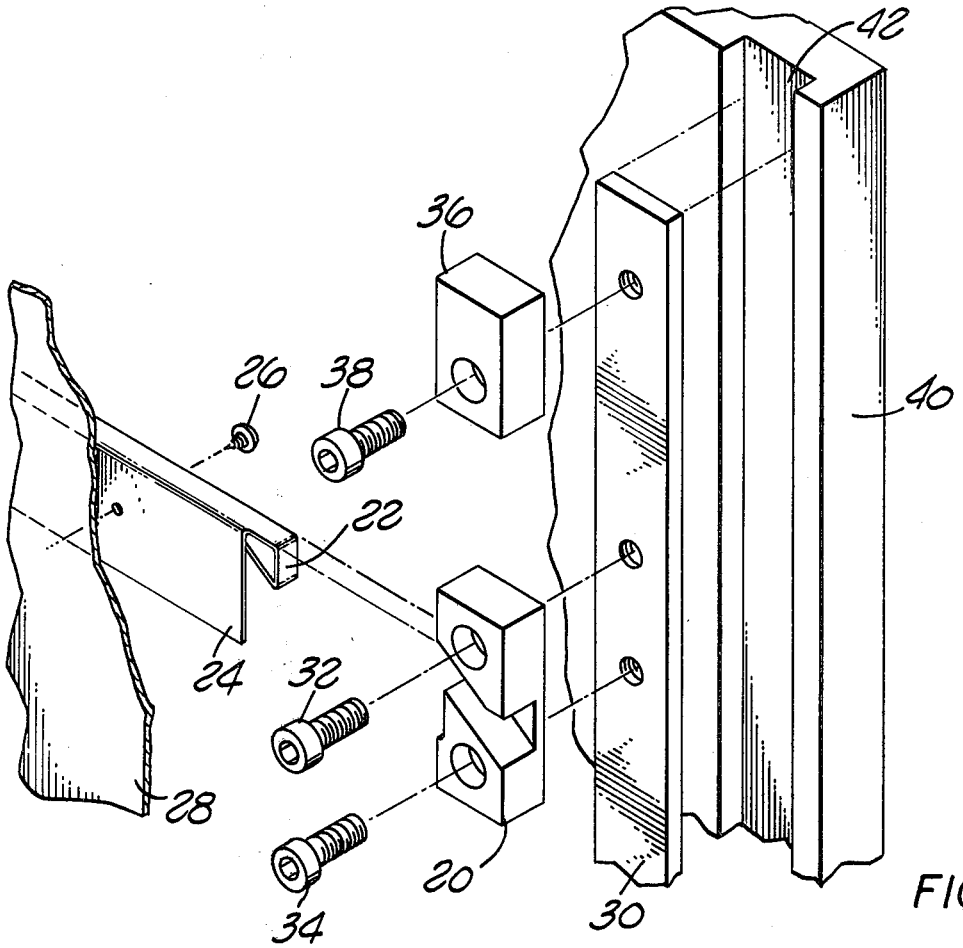
FIG. 2 is an exploded perspective view of drawer and of cabinet locking apparatus according to the present invention.

FIG. 2 is an exploded perspective view of the lock mechanisms of the present invention. These locks rely upon the interaction of a plurality of drawer locks (one for each drawer of the cabinet) such as the lock 20 with a key 22 formed at the end of rail member 24. The rail member 24 is affixed by conventional fastening means such as a screw 26 to the side 28 of a drawer. The drawer lock 20, which is preferably formed of hard rubberized or other elastomeric material, is affixed to a bar 30 (preferably metallic) by means of machine screws 32, 34. A block member 36, also preferably of elastomeric material, is fixed to the top of the bar by means of a machine screw 38. The bar 30, including the lock 20 and the block 36 affixed thereto is slidably engaged to a side 40 of the shell 12 of the cabinet at a groove 42. The interaction of the key 22 with the lock 20 is illustrated in FIGS. 3*a, b* and *c*. These figures present side views of the respective members prior to, during and after the opening of the drawer to which the rail member 24 has been affixed. One can see in FIG. 3*a* that the lock 20 is divided into upper and lower portions 44, 46 joined together by a recessed web 48. The upper and lower portions 44, 46 are vaguely complementary including opposed inclined surfaces 50, 52. A notch 54 is provided at the rear of the lower portion 46. The notch 54 will be seen to provide a recessed vertical surface which assists the locking of the abutting key 22.

The relative positions of the key 22 and the lock 20, as shown in FIG. 3*a*, presuppose that no drawer of the file cabinet 10 has been opened. As can be seen, the key 22 is located opposed the inclined surface 50 of the upper portion 44 of the drawer lock 20. The spacing of the inclined surfaces 50, 52 exceeds the width of the blunt end of the key 22. A small amount of resistance against the opening of the drawer is provided by the abutment of the blunt end of the key 22 and the inclined surface 50. Thus the lock 20 provides a detent that prevents the undesired opening of the drawer as a result of being positioned on an uneven surface, for example. In FIG. 3*b*, the key 22 is advanced against the inclined surface 50 as a result of the rightward sliding of the drawer associated therewith. The key 22 travels in a level plane since it is affixed to the side of the drawer. As it advances, the inclined surface 50 and associated lock 20 are raised as seen in FIG. 3*b*. Since the drawer lock 20 is a single piece, the notch 54 in the lower portion 46 is also raised. FIG. 3*c* illustrates the position of the lock 20 after the door has been opened. By viewing FIGS. 3*a*, *b* and *c* side-by-side, one may observe that the notch 54 has moved to a position wherein it is at approximately the level of the blunt end of the key 22.

Figure 4A:
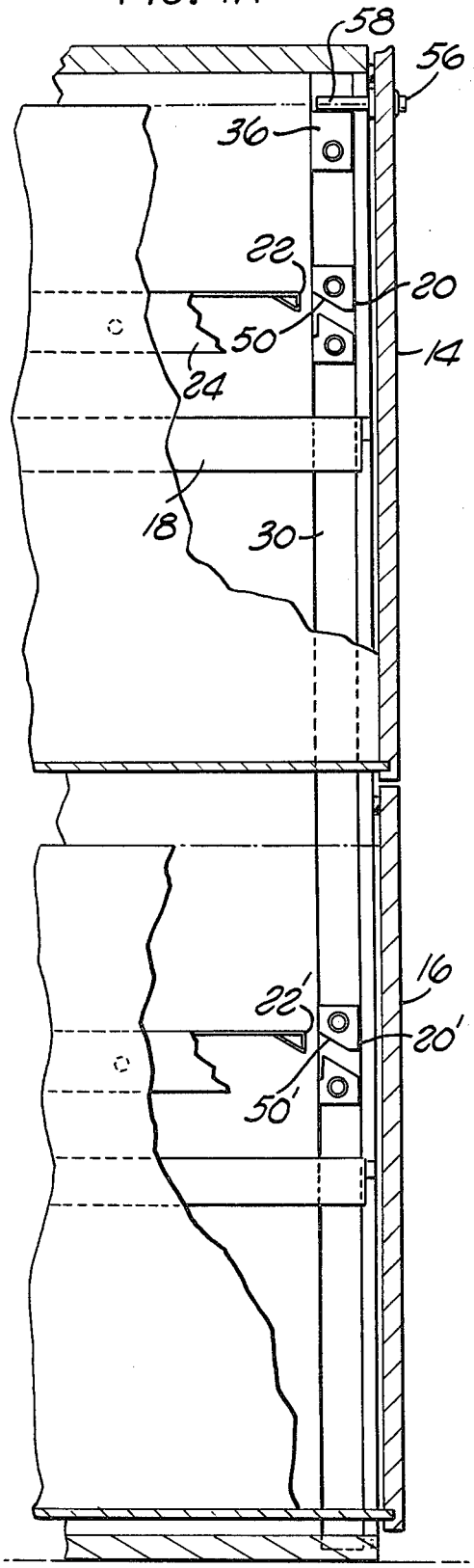
FIGS. 4*a* and *b* are partially sectioned side views of a file cabinet incorporating the present invention with both drawers closed and with one drawer open, respectively.
Figure 4B:
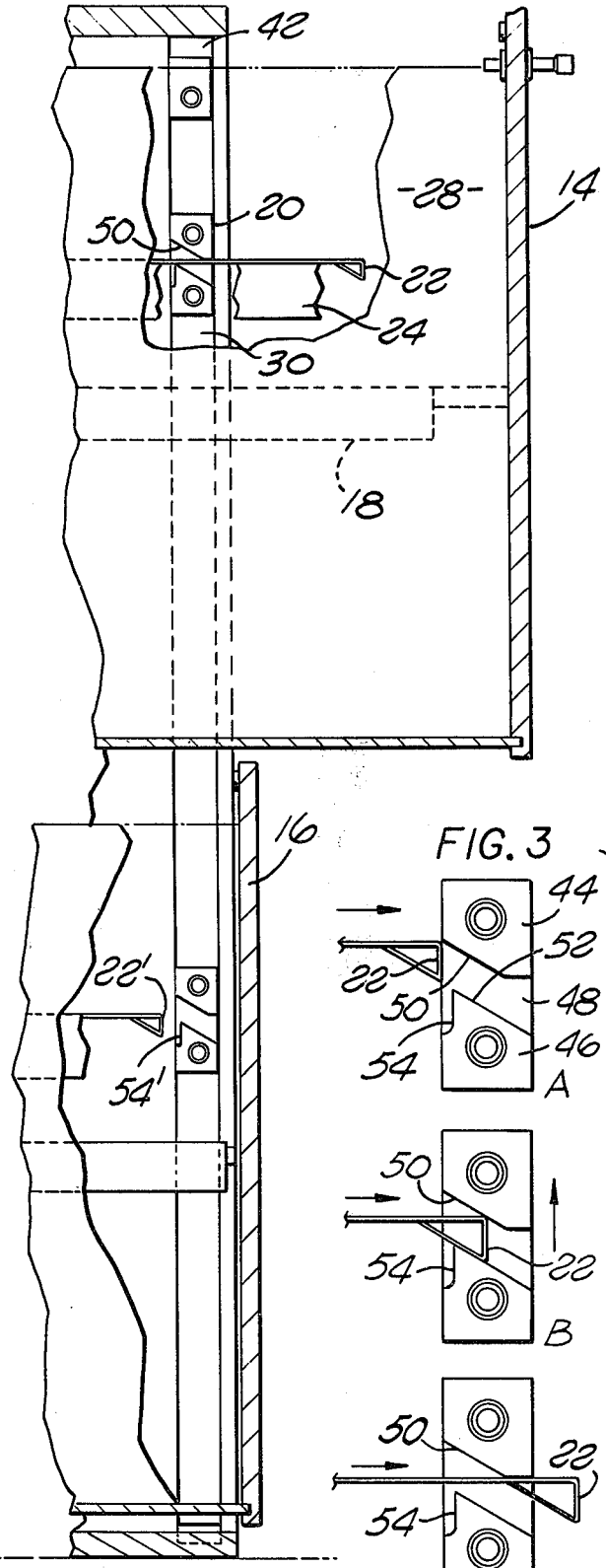
Figure 3:
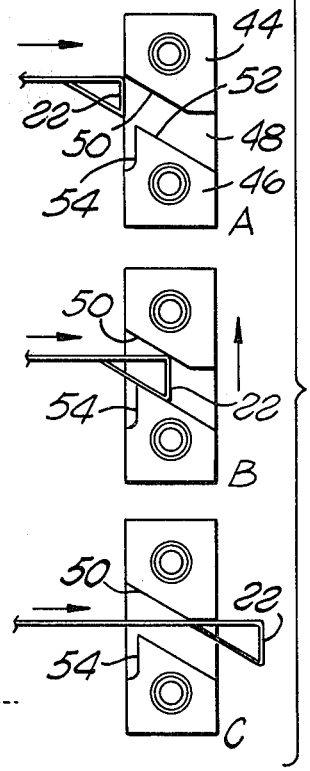
FIGS. 3*a, b* and *c* are side views showing the relative positions of a drawer lock and associated key of the present invention in the closed, mid-open and open drawer positions respectively.

FIGS. 4*a* and 4*b* demonstrate the method by which the opening of one drawer of a cabinet effects the locking of the remaining drawers. The figures present partially sectioned side views of the interior of a file cabinet 10 such as that shown in FIG. 1. In FIG. 4*a*, both upper drawer 14 and lower drawer 16 are closed. In this configuration, the blunt ends of the keys 22, 22' associated with the drawers 14 and 16 are aligned with locks 20 and 20' as shown in FIG. 3*a*. That is, when extended, each will abut its corresponding lock at the inclined surface 50 or 50' of the lock. As discussed with respect to FIGS. 3(*a*)–(*c*), the locks 20, 20' each allow the passage of the blunt end of the key 22 or 22' therethrough, allowing the corresponding drawer to be opened.

Although the relationship between the keys 22, 22' and corresponding locks 20, 20' as shown in FIG. 4*a* is such as to allow their passage when the lock is free to travel upwardly, all drawers of the cabinet 10 may be prevented from opening by movement of the extensible cylindrical member 58 of a conventional lock 56 into abutting relationship with the block 36. The cylindrical member 58, when extended as shown in FIG. 4*a*, restrains the block 36 and associated bar 30 from any upward movement. The locks 20, 20', rigidly engaged to the bar 30, are thus restrained from the upward movement otherwise occasioned by the force of the blunt end of a key against the inclined surface of the upper portion of a drawer lock. In this way, the extension of the cylindrical member 58 (effected, for example, by the turning of a key in the conventional lock 56) locks all of the drawers of the file cabinet 10.

In FIG. 4*b* the cylindrical member 58 of the cabinet lock 56 has been retracted to allow the free movement of the bar 30 relative to the shell of the cabinet 10. By retracting the cylindrical member 58, the upper drawer may now be opened. As discussed with regard to FIGS. 3(*a*)–(*c*), the force exerted by the blunt end of the key 22 against the inclined surface 50 results in the application of a force tending to urge the lock 20 upward. The upward movement of the lock 20 results in a corresponding upward movement of the bar 30 within the groove 42 in the side of the cabinet shell. Similarly, the lower lock 20', also rigidly affixed to the bar 30, is raised by a like amount. As can be seen, the blunt end of the key 22' associated with the lower drawer 16 no longer lies opposite the inclined surface of the upper portion of the key 20' as in FIG. 4*a* but, rather, lies opposite the notch 54' formed in the rear of the lower member of the key 20'. The notch 54' presents a vertical surface that will prevent the passage of the blunt end of the key 22' associated with the lower drawer 16 therethrough. Thus, the opening of the upper drawer 14 results in the effective locking of the lower drawer 16.

By like analysis, the opening of the lower drawer 16 can be shown to effect the automatic locking of the upper drawer 14. The present invention may be extended to file cabinets containing any number of drawers by affixing a rail member having a key which presents a blunt end to each additional drawer of the file and rigidly attaching to the bar 30 a corresponding drawer lock conforming to the locks 20, 20' disclosed herein. By such adaptation, the opening of any drawer of the file cabinet will effect the upward movement of all drawer locks so that any effort to open an additional drawer will be blocked by the abutment of the blunt face to its key with the notch in the lower portion of its associated drawer lock.

Thus, it is seen that there has been brought to the furniture and related arts, new and improved locking apparatus. Two separate locking modes may be achieved according to the present invention which features the use of a vertically movable enlongated member. In a first mode, the entire cabinet may be locked by the extension of a cylindrical member of a cabinet lock to abut a block affixed to the top of the elongated member. In such manner, vertical movement of the elongated member is prevented so that each of a plurality of door locks presents an immovable surface to the blunt end of a key preventing the passage of any key through its associated drawer lock.

In an alternate mode, the cylinder of the cabinet lock is retracted so that any one of the drawers of the cabinet may be opened. The opening of a single drawer raises the elongated member, thereby positioning each door lock to prevent the opening of any of the remaining drawers. In such a mode the possibility of the file cabinet being tipped over by the generation of excessive moments is minimized.

What is claimed is:

1. In a file cabinet having top, bottom, rear and side walls and an open front, a plurality of slidable drawers arranged to slide from an inner closed position outwardly through the open front to an open position for removal of contents thereof, a lock means for preventing the movement to said open position of more than one of said drawers at a time, said lock means comprising:

a unitary bar slidably carried by one of said side walls adjacent said open front and vertically movable between first and second positions;

a rail member extending horizontally and affixed rigidly to a side of each drawer and terminating in a key positioned adjacent but displaced from said bar when said drawers are in said closed position; means for defining an included surface for each drawer rigidly affixed to said bar and extending downwardly toward said open front, said surfaces each being disposed to be engaged by one of said keys when a drawer is moved from its closed position toward its open position and all other drawers are in their closed positions, said bar being moved from its first position vertically upward to its second position as said key moves along and in engagement with said inclined surface, said bar being maintained in said second position solely by said inclined surface defining means for engagement with said rail after said rail is in its second position and during the time said drawer is in other than its closed position; and means for defining a substantially vertical surface for each drawer rigidly affixed to said bar and disposed to abut the key on a drawer when said rod is in its second position.

2. Lock means for a file cabinet as defined in claim 1 wherein said means for defining each said inclined and vertical surface adjacent each said key is a unitary member secured to said bar.

3. Lock means for a file cabinet as defined in claim 2 wherein said unitary member defines a second inclined surface disposed opposed and spaced from said inclined surface by a predetermined amount, said predetermined amount being sufficient to permit passage of said key therethrough.

4. Lock means for a file cabinet as defined in claim 3 wherein said vertical surface and said second inclined surface are co-terminus and said key defines a second substantially vertical surface, said key vertical surface and said unitary member vertical surface abut when said bar is in its second position.

5. Lock means for a file cabinet as defined in claim 4 which further includes a block means affixed rigidly to said bar at the uppermost portion thereof and an extensible, retractable member disposed on said cabinet, said extensible, retractable member, when extended, preventing movement of said bar from its first position thereby precluding opening of any of said drawers.

* * * * *